US011187044B2

(12) United States Patent
Noui-Mehidi et al.

(10) Patent No.: US 11,187,044 B2
(45) Date of Patent: Nov. 30, 2021

(54) PRODUCTION CAVERN

(71) Applicant: Saudi Arabian Oil Company, Dhahran (SA)

(72) Inventors: Mohamed Nabil Noui-Mehidi, Dhahran (SA); Khalid M. Al-Ruwaili, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 48 days.

(21) Appl. No.: 16/709,164

(22) Filed: Dec. 10, 2019

(65) Prior Publication Data

US 2021/0172256 A1 Jun. 10, 2021

(51) Int. Cl.
*E21B 7/30* (2006.01)
*E21B 47/04* (2012.01)
*E21B 47/08* (2012.01)

(52) U.S. Cl.
CPC ..... *E21B 7/30* (2013.01); *E21B 47/04* (2013.01); *E21B 47/08* (2013.01)

(58) Field of Classification Search
CPC ..... E21B 7/30; E21B 47/08; E21B 47/04
See application file for complete search history.

(56) References Cited

U.S. PATENT DOCUMENTS 2,145,745 A 1/1939 Armstrong et al.
2,699,212 A 1/1955 Dismukes
2,804,148 A 8/1957 Schremp et al.
3,254,720 A 8/1966 Huitt
3,302,717 A 2/1967 West et al.
3,354,955 A 11/1967 Beny
3,419,080 A 12/1968 Lebourg
3,438,203 A 4/1969 Lamb et al.
3,448,305 A 6/1969 Raynal et al.
3,525,398 A 8/1970 Fisher
3,558,936 A 1/1971 Horan
3,649,485 A 3/1972 Chisholm
(Continued)

FOREIGN PATENT DOCUMENTS

CN 202916242 5/2013
CN 103733061 4/2014
(Continued)

OTHER PUBLICATIONS

"Constructing Experiment Platform of Ultrasonic Attenuation Concentration Meter", Nov. 2007, 3 pages English Abstract.
(Continued)

*Primary Examiner* — Nicole Coy
*Assistant Examiner* — Yanick A Akaragwe
(74) *Attorney, Agent, or Firm* — Fish & Richardson P.C.

(57) ABSTRACT

A method includes spraying acid onto an inner wall of a wellbore formed in a subterranean zone with entrapped hydrocarbons that flow into the subterranean zone. Spraying the acid forms a subterranean cavern within a portion of the wellbore, the subterranean cavern being wider than the wellbore. The entrapped hydrocarbons flow into the subterranean cavern. The entrapped hydrocarbons include liquid hydrocarbons and water. The liquid hydrocarbons and the water separate under gravity within the subterranean cavern. The method also includes drawing the liquid hydrocarbons from the subterranean cavern to a surface of the wellbore.

15 Claims, 10 Drawing Sheets

(56) References Cited

U.S. PATENT DOCUMENTS 3,663,845 A 5/1972 Apstein
3,759,328 A * 9/1973 Ueber ..... E21B 43/24 166/272.1
3,762,476 A 10/1973 Gall
3,858,654 A * 1/1975 Walker ..... E21B 43/281 166/272.6
3,943,005 A 3/1976 Mund
3,970,877 A 7/1976 Russell et al.
4,080,837 A 3/1978 Alexander et al.
4,114,691 A * 9/1978 Payton ..... E21B 36/00 166/276
4,118,294 A 10/1978 Pellegri
4,163,770 A 8/1979 Porosoff
4,381,674 A 5/1983 Abts
4,387,318 A 6/1983 Kolm et al.
4,406,499 A 9/1983 Yildirim
4,526,480 A 7/1985 Ward
4,527,420 A 7/1985 Foote
4,536,674 A 8/1985 Schmidt
4,572,295 A 2/1986 Walley
4,687,061 A 8/1987 Uhri
4,817,721 A 4/1989 Pober
4,819,723 A 4/1989 Whitfill
4,853,507 A 8/1989 Samardzija
4,873,121 A 10/1989 Strack et al.
5,004,886 A 4/1991 Bom
5,070,725 A 12/1991 Cox et al.
5,072,087 A 12/1991 Apte
5,095,758 A 3/1992 Cox et al.
5,115,670 A 5/1992 Shen
5,148,405 A 9/1992 Belchamber et al.
5,150,619 A 9/1992 Turner
5,161,615 A 11/1992 Hutchins et al.
5,197,783 A * 3/1993 Theimer ..... E21B 43/29 175/67
5,317,223 A 5/1994 Kiesewetter et al.
5,415,048 A 5/1995 Diatschenko et al.
5,561,245 A 10/1996 Georgi et al.
5,714,691 A 2/1998 Hill
5,741,293 A 4/1998 Wijay
5,965,964 A 10/1999 Skinner et al.
6,056,882 A 5/2000 Scalliet
6,077,400 A 6/2000 Kartchner
6,102,120 A 8/2000 Chen et al.
6,151,958 A 11/2000 Letton et al.
6,196,312 B1 3/2001 Collins et al.
6,214,236 B1 4/2001 Scalliet
6,315,062 B1 * 11/2001 Alft ..... E21B 7/046 175/45
6,320,156 B1 11/2001 Yamaguchi
6,452,068 B1 9/2002 Zuo et al.
6,467,358 B1 10/2002 Nishi
6,504,258 B2 1/2003 Schultz et al.
6,540,777 B2 4/2003 Stenzel
6,547,003 B1 4/2003 Bangash et al.
6,550,535 B1 4/2003 Traylor
6,593,281 B2 7/2003 Hayden
6,655,221 B1 12/2003 Aspelund et al.
6,672,385 B2 1/2004 Kilaas et al.
6,768,214 B2 7/2004 Schultz et al.
6,831,470 B2 12/2004 Xie et al.
6,834,725 B2 12/2004 Whanger et al.
6,938,470 B2 9/2005 DiFoggio et al.
6,993,979 B2 2/2006 Segeral
7,036,356 B2 5/2006 Leppanen et al.
7,162,918 B2 1/2007 DiFoggio et al.
7,199,480 B2 4/2007 Fripp et al.
7,224,077 B2 5/2007 Allen
7,242,103 B2 7/2007 Tips
7,249,805 B2 7/2007 Cap
7,317,989 B2 1/2008 DiFoggio et al.
7,345,372 B2 3/2008 Roberts et al.
7,357,189 B2 4/2008 Aldaz et al.
7,486,248 B2 2/2009 Halek et al.
7,562,584 B2 7/2009 Conquergood
7,665,537 B2 2/2010 Patel et al.
7,775,125 B2 8/2010 Rhodes
7,775,961 B2 8/2010 Meikrantz
7,810,563 B2 10/2010 Buijse et al.
7,823,635 B2 11/2010 Wright et al.
7,842,276 B1 11/2010 Linkous
7,847,421 B2 12/2010 Gardner et al.
7,891,416 B2 2/2011 Pankratz et al.
7,906,861 B2 3/2011 Guerrero et al.
7,908,930 B2 3/2011 Xie et al.
8,047,232 B2 11/2011 Bemitsas
8,061,186 B2 11/2011 Gysling
8,072,226 B2 12/2011 Park
8,258,644 B2 9/2012 Kaplan
8,421,251 B2 4/2013 Pabon et al.
8,426,988 B2 4/2013 Hay
8,431,015 B2 4/2013 Banerjee et al.
8,521,436 B2 8/2013 Agar
8,523,936 B2 9/2013 Schmid et al.
8,564,179 B2 10/2013 Ochoa et al.
8,586,898 B2 11/2013 Novak
8,604,634 B2 12/2013 Pabon et al.
8,631,872 B2 1/2014 East
8,638,002 B2 1/2014 Lu
8,648,480 B1 2/2014 Liu et al.
8,786,113 B2 7/2014 Tinnen et al.
8,916,983 B2 12/2014 Marya et al.
8,925,627 B2 1/2015 Tupper et al.
8,925,649 B1 1/2015 Wiebe et al.
9,091,144 B2 7/2015 Swanson et al.
9,106,159 B1 8/2015 Wiebe et al.
9,116,105 B2 8/2015 Venemso et al.
9,121,237 B2 9/2015 Kumar
9,130,161 B2 9/2015 Nair et al.
9,239,043 B1 1/2016 Zeas
9,322,255 B2 4/2016 Diehl et al.
9,322,389 B2 4/2016 Tosi
9,441,997 B2 9/2016 Downie et al.
9,844,166 B2 12/2017 Shelutt et al.
10,367,434 B2 7/2019 Ahmad
2002/0178805 A1 12/2002 DiFoggio et al.
2002/0178837 A1 12/2002 Brandt
2003/0074982 A1 4/2003 Spielman
2003/0098605 A1 5/2003 Vinegar
2003/0141882 A1 7/2003 Zou
2003/0201104 A1 10/2003 Bergman et al.
2004/0072061 A1 4/2004 Nakano
2004/0129428 A1 7/2004 Kelley
2004/0144535 A1 7/2004 Kalman et al.
2005/0070427 A1 3/2005 Pak
2005/0176989 A1 8/2005 Coleman
2006/0086498 A1 4/2006 Wetzel et al.
2006/0240187 A1 10/2006 Weidman
2007/0138020 A1 6/2007 Balagopal
2008/0048455 A1 2/2008 Carney
2008/0163700 A1 7/2008 Huang
2008/0277941 A1 11/2008 Bowles
2009/0058226 A1 3/2009 Furuhata et al.
2009/0071646 A1 3/2009 Pankratz et al.
2009/0074641 A1 3/2009 Lewis
2009/0166045 A1 7/2009 Wetzel et al.
2009/0178809 A1 7/2009 Jeffryes et al.
2010/0164231 A1 7/2010 Tsou
2010/0193193 A1 8/2010 Wagg et al.
2010/0252445 A1 10/2010 Highgate
2010/0256424 A1 10/2010 Zhang
2010/0308592 A1 12/2010 Frayne
2011/0049901 A1 3/2011 Tinnen
2011/0259120 A1 10/2011 Thonstad
2011/0267074 A1 11/2011 Xie et al.
2011/0273032 A1 11/2011 Lu
2012/0055667 A1 3/2012 Ingram et al.
2012/0061237 A1 3/2012 Brichese et al.
2012/0065052 A1 3/2012 Ewald
2012/0292915 A1 11/2012 Moon
2012/0312538 A1 12/2012 Koolman
2013/0110411 A1 5/2013 Black et al.
2013/0119669 A1 5/2013 Murphree

(56) References Cited

U.S. PATENT DOCUMENTS

| | | | | |
|---|---|---|---|---|
| 2013/0200628 | A1 | 8/2013 | Kane | |
| 2013/0213795 | A1 | 8/2013 | Strohm et al. | |
| 2013/0227940 | A1 | 9/2013 | Greenblatt | |
| 2013/0255370 | A1 | 10/2013 | Roux et al. | |
| 2014/0136125 | A1 | 5/2014 | Agar et al. | |
| 2014/0154173 | A1 | 6/2014 | Phillips | |
| 2014/0162873 | A1 | 6/2014 | Gu | |
| 2014/0167418 | A1 | 6/2014 | Hiejima | |
| 2014/0175800 | A1 | 6/2014 | Thorp | |
| 2014/0260659 | A1 | 9/2014 | Sheila-Vadde | |
| 2014/0284937 | A1 | 9/2014 | Dudley et al. | |
| 2014/0338921 | A1 | 11/2014 | Barty et al. | |
| 2015/0267501 | A1 | 9/2015 | Al-Gouhi | |
| 2015/0275636 | A1 | 10/2015 | Diehl et al. | |
| 2015/0293056 | A1 | 10/2015 | Kelly | |
| 2015/0308248 | A1 | 10/2015 | Diehl et al. | |
| 2016/0076925 | A1 | 3/2016 | Chen | |
| 2016/0168957 | A1 | 6/2016 | Tubel | |
| 2016/0201440 | A1 | 7/2016 | Aidagulov | |
| 2016/0273947 | A1 | 9/2016 | Mu et al. | |
| 2016/0284979 | A1 | 9/2016 | Fukui | |
| 2017/0033713 | A1 | 2/2017 | Petroni | |
| 2017/0090060 | A1 | 3/2017 | Donderici | |
| 2017/0342812 | A1* | 11/2017 | Kuhn | B01D 17/044 |
| 2018/0112490 | A1 | 4/2018 | Al-Gouhi et al. | |
| 2018/0266183 | A1 | 9/2018 | Ayub | |
| 2018/0351480 | A1 | 12/2018 | Ahmad | |
| 2019/0002722 | A1 | 1/2019 | May | |
| 2019/0120041 | A1* | 4/2019 | Avasarala | E21B 47/04 |
| 2019/0253003 | A1 | 8/2019 | Ahmad | |
| 2019/0253004 | A1 | 8/2019 | Ahmad | |
| 2019/0253005 | A1 | 8/2019 | Ahmad | |
| 2019/0253006 | A1 | 8/2019 | Ahmad | |

FOREIGN PATENT DOCUMENTS

| | | |
|---|---|---|
| CN | 104155358 | 11/2014 |
| DE | 3007503 | 9/1981 |
| DE | 202012103729 | 10/2012 |
| EP | 2009231 | 12/2008 |
| EP | 2820338 | 1/2015 |
| WO | WO 200046133 | 8/2000 |
| WO | WO 2001022041 | 3/2001 |
| WO | WO 2008003365 | 1/2008 |
| WO | WO 2009046709 | 4/2009 |
| WO | WO 2011053714 | 5/2011 |
| WO | WO 2011142738 | 11/2011 |
| WO | WO 2013005091 | 1/2013 |
| WO | WO 2013155061 | 10/2013 |
| WO | WO 2014171960 | 10/2014 |
| WO | WO 2014189533 | 11/2014 |
| WO | WO 2015140636 | 9/2015 |
| WO | WO 2015142330 | 9/2015 |

OTHER PUBLICATIONS

Abdel-Aal et al., "Parametric study for saline water electrolysis: Part II: chlorine evolution, selectivity and determination," Int. J. Hydrogen Energy, 1993, 18(7), 545-551.

Addali et al., "Acoustic Emission and Gas-Phase Measurements in Two-Phase Flow," published in 2010, 11 pages.

Al-Qahtani et al., "A Semi-Analytical Model for Extended-Reach Wells with Wellbore Flow Splitting; a Production Optimization Scheme," SPE-177931, presented at the Abu Dhabi International Petroleum Exhibition and Conference, Nov. 9-12, 2015, 21 pages.

Alssayh et al., "Determining Slug Velocity in Two-Phase Flow with Acoustic Emission," Sep. 2012, 8 pages.

Bilgen et al., "An assessment of large-scale solar hydrogen production in Canada," International Journal of Hydrogen Energy, 1983, vol. 8, issue 6, 441-451.

ceramicindustry.com' [online], "Microwave Heating of Ceramics," Oct. 1, 2015, [retrieved on May 15, 2018], retrieved from URL: <https://www.ceramicindustry.com/articles/95044-microwave-heating-of-ceramics>, 4 pages.

Chen et al., "Highly active and durable nanostructured molybdenum carbide electrocatalysts for hydrogen production," Energy Environ, Sci. 2013, 6, 943-951.

Chew, "Mechanical vacuum pumps," BOC Edwards, Crawley, United Kingdom, 2007, 22 pages.

Dos Reis et al., "A Non-Intmsive Probe for Bubble Profile and Velocity Measurement in Horizontal Slug Flows," Science Direct, Published in 2005, pp. 229-239.

Esposito et al., "Low-Cost Hydrogen-Evolution Catalysts Based on Monolayer Platinum on Tungsten Monocarbide Substrates," Chem. Int. Ed. 2010, 49, 9859-9862.

Fornarelli et al., "Flow patterns and heat transfer around six in-line circular cylinders at low Reynolds number," JP Journal of Heat and Mass Transfer, Pushpa Publishing House, Allahabad, India, Feb. 2015, vol. 11, No. 1; pp. 1-28.

Gonzalez et al., "Downhole Viscosity Measurement Platform using Tuning Fork Oscillators," Copyright 2015, 4 pages.

Govardhan et al., "Critical mass in vortex-induced vibration of a cylinder," European Journal of Mechanics B/Fluids, Jan.-Feb. 2004, vol. 23, No. 1; pp. 17-27.

Hanyang et al., "Experimental Investigation of Slug Development on Horizontal Two-Phase Flow," Chinese Journal of Chemical Engineering, 16(2), Copyright, 2008, pp. 171-177.

Harnisch et al., "Tungsten carbide as electrocatalyst for the hydrogen evolution reaction in pH neutral electrolyte solutions," Applied Catalysis B: Environmental, Jul. 2009, vol. 89, issues 3-4, 455-458.

Heinisch et al., "Resonant Steel Tuning Forks for precise inline viscosity and mass density measurements in harsh environments," Proceedia Engineering, vol. 87, Dec. 2014, pp. 1139-1142.

Hsu et al., "Atomic layer deposition synthesis of platinum-tungsten carbide core-shell catalysts for the hydrogen evolution reaction," Chemical Communications 2012, vol. 48, issue 7, 1063-1065.

Husin et al., "Acoustic Emission for Monitoring Two-Phase Flow," EWGAE 2010, Sep. 2010, 7 pages.

Ismail et al., "Microcontroller Based Automated Body Mass Index (BMI) Calculator with LCD Display," 2nd International Conference on Electrical, Electronics and Civil Engineering (ICEECE'2012), Apr. 28-29, 2012, 3 pages.

Kyle et al., "Bioelectrical impedance analysis—part 1: review of principles and methods," Clinical Nutrition, Oct. 2004, 18 pages.

Liao et al., "A nanoporous molybdenum carbide nanowire as an electrocatalyst for hydrogen evolution reaction," Energy Environ, Sci. 2014, 7, 387-392.

Nagai et al., "Tungsten and nickel tungsten carbides as anode electrocatalysts," Electrochimica Acta, Elsevier Science Publishers, vol. 52, No. 17, Mar. 1, 2007, pp. 5430-5436.

Nydal et al., "Statistical Characterization of Slug Flow in Horizontal Pipes", Int. J. Multiphase Flow, vol. 18, No. 3, Published in 1992, pp. 439-453.

Raza et al., "Liquid Density Measurement using Tuning Fork," International Journal of Current Engineering and Technology, vol. 5, No. 1, Feb. 2015, 4 pages.

Rodella et al., "Physical and chemical studies of tungsten carbide catalysts: effects of Ni promotion and sulphonated carbon," RSC ADV., vol. 5, No. 30, Feb. 24, 2015, p. 23874-23885.

Sahel et al., "In-Situ Polymerisation of an Inflatable Composite Sleeve to Reline Damaged Tubing and Shut-Off Perforation," SPE 8202, presented at the Offshore Technology Conference, May 6-9, 1996, 9 pages.

Sanderson et al., "Guidelines for the Use of Ultrasonic Non-Invasive Metering Techniques"; Flow Measurement and Instrumentation; vol. 13, No. 4; Aug. 31, 2002; pp. 125-142.

Shi et al., "Research and Application of Drilling Technology of Extended-reach Horizontally-intersected Well Used to Extract Coalbed Methane," 2011 Xi'an International Conference on Fine Geological Exploration and Groundwater & Gas Hazards Control in Coal Mines, Procedia Earth and Panetary Science vol. 3, Dec. 2011, 9 pages.

Steeb et al., "Solar hydrogen production: Photovoltaic/electrolyzer system with active power conditioning," International Journal of Hydrogen Energy, 1985, vol. 10, issue 6, 353-358.

(56) References Cited

OTHER PUBLICATIONS

Tran et al., "Novel cobalt/nickel-tungsten-sulfide catalysts for electrocatalytic hydrogen generation from water," Energy & Environmental Science, issue 8, vol. 6, 2013, pp. 2452-2459.
Xi et al., "Uncertainty Analysis Method for Intersecting Process of U-Shaped Horizontal Wells," Arabian Journal for Science and Engineering, vol. 40, Issue 2, Feb. 2015, 12 pages.
Xu et al., "Pt and Pd Supported on Carbon Microspheres for Alcohol Electrooxidation in Alkaline Media," International Journal of Electrochemical Science, 2007, vol. 2, 674-680.
Zhang et al., "A Measurement Method of Slug Flow Velocity of Gas-Liquid Two-Phase Flow in Horizontal Pipe," Copyright 2010, 5 pages.
Zheng et al., "Design and Theoretical Analysis of a Resonant Sensor for Liquid Density Measurement," Sensors, Jun. 8, 2012; No. 12, pp. 7905-7916.
PCT International Search Report and Written Opinion issued in International Application No. PCT/US2020/063988 dated Mar. 18, 2021, 15 pages.

* cited by examiner

PRODUCTION CAVERN

TECHNICAL FIELD

This disclosure relates to systems and methods for to processing subterranean formations from which hydrocarbons can be produced.

BACKGROUND

Various techniques can be used to produce oil from a subterranean zone. Artificial lifting mechanisms, such as electrical submersible pumps and gas lifts, are often used to add energy to the fluid column in a wellbore in order to increase the amount of oil produced from a subterranean zone. However, the oil produced from a subterranean zone using artificial lifting techniques often results in the oil being lifted with other formation fluids, such as water.

SUMMARY

This disclosure describes systems and methods for forming subterranean caverns.

In an example implementation, a method includes spraying acid onto an inner wall of a wellbore. The wellbore is formed in a subterranean zone with entrapped hydrocarbons that flow into the subterranean zone. Spraying the acid forms a subterranean cavern within a portion of the wellbore, the subterranean cavern being wider than the wellbore. The entrapped hydrocarbons flow into the subterranean cavern. The entrapped hydrocarbons include liquid hydrocarbons and water. The liquid hydrocarbons and the water separate under gravity within the subterranean cavern. The method also includes drawing the liquid hydrocarbons from the subterranean cavern to a surface of the wellbore.

This, and other implementations, can include one or more of the following features. The method can further include positioning an acidizing tool within the wellbore, supplying acid to the acidizing tool, rotating the acidizing tool about 360 degrees, and, in response to determining that a radius of a portion of the wellbore proximate the acidizing tool is about 300 percent to about 400 percent an initial radius of the wellbore, raising the acidizing tool within the wellbore towards the surface. Determining that the radius of the portion of the wellbore proximate the acidizing tool is about 300 percent to about 400 percent an initial radius of the wellbore can include measuring the radius of the portion of the wellbore proximate the acidizing tool using one or more ultrasonic sensors coupled to the acidizing tool. An upper portion of the subterranean cavern can be dome-shaped. The method can further include rotating the acidizing tool between a first position and a second position to form the upper portion of the subterranean cavern. The acidizing tool can include a center hub coupled to an end of a downhole conveyance, one or more projections extending radially from the center hub, and an opening through each of the one or more projections, wherein the one or more projections are positioned substantially perpendicular to a longitudinal axis of the downhole conveyance in the first position and are positioned substantially parallel to the longitudinal axis of the downhole conveyance in the second position. Drawing the liquid hydrocarbons from the subterranean cavern to a surface of the wellbore can include positioning a pump in an oil column formed in the subterranean cavern. Positioning a pump in an oil column formed in the subterranean cavern can include positioning a liquid level sensor in the subterranean cavern, wherein the liquid level sensor is configured to detect oil-water interfaces and oil-gas interfaces, based on detecting at least one of an oil-water interface and an oil-gas interface, determining a center of the oil column, and positioning the pump at the center of the oil column. Determining the center of the oil column can include receiving a signal from the liquid level sensor indicating a depth corresponding to an oil-gas interface in the subterranean cavern, receiving a signal from the liquid level sensor indicating a depth corresponding to an oil-water interface in the subterranean cavern, and calculating an average of the depth of the oil-gas interface and the depth of the oil-water interface. The liquid level sensor can be coupled to the pump, and positioning a liquid level sensor in the subterranean cavern can include lowering the pump into the subterranean cavern In some implementations, a system for producing liquid hydrocarbons from a formation includes an acidizing tool configured to rotate and spray acid onto an inner wall of a wellbore to form a subterranean cavern, and a controller communicably coupled to the acidizing tool. The controller is configured to perform operations that include controlling the acidizing tool to rotate about a downhole conveyance coupled to the acidizing tool and spray acid onto an inner wall of a wellbore. The operations also include, in response to receiving a signal indicating that a radius of the wellbore is at least a threshold radius, causing the acidizing tool to be raised uphole within the wellbore. The operations also include, in response to determining that a depth of the subterranean cavern is at least a threshold depth, rotating the acidizing tool to form a dome-shaped upper portion of the subterranean cavern.

This, and other implementations, can include one or more of the following features. The depth of the subterranean cavern can be about 30 percent to about 50 percent a total depth of the wellbore. The depth of the subterranean cavern can be equal to a depth of an oil-bearing subterranean formation. The system can further include a submersible pump configured to draw liquid hydrocarbons from the subterranean cavern, and a liquid level sensor, and the controller can be communicably coupled to the submersible pump and the liquid level sensor. The operations can further include, in response to receiving a first signal from the liquid level sensor indicating an oil-water interface and a second signal from the liquid level sensor indicating an oil-gas interface, determining a center of an oil column formed by gravity separation in the subterranean cavern, and, in response to determining the center of the oil column, positioning the submersible pump in the center of the oil column. The liquid level sensor can be coupled to the submersible pump, and the operations can include lowering the submersible pump through the subterranean cavern. The system can include one or more ultrasonic sensors coupled to the acidizing tool, and the signal indicating that the radius of the wellbore is at least a threshold radius can be received by the controller from the one or more ultrasonic sensors. The system can include an acid source fluidly coupled to the acidizing tool, and controlling the acidizing tool to spray acid onto an inner wall of a wellbore can include pumping acid from the acid source to the acidizing tool. The acidizing tool can include one or more projections extending radially from a hub coupled to an end of a downhole conveyance, and an opening through each of the one or more projections. The operations can further include controlling the acidizing to rotate between a first position and a second position to form the upper portion of the subterranean cavern, wherein the one or more projections are positioned substantially perpendicular to a longitudinal axis of the downhole conveyance in the first position and the one or more projections are positioned substantially parallel to the longitudinal axis of the downhole conveyance in the second position.

Example implementations of the present disclosure can include one, some, or all of the following features. For example, a subterranean cavern formed by a system or method according to the present disclosure can improve downhole gravity separation of formation fluids. A subterranean cavern formed by a system or method according to the present disclosure can increase the inflow of formation fluids into the wellbore. A subterranean cavern formed by a system or method according to the present disclosure can reduce the cost and time required to produce oil from a subterranean zone by, for example, reducing or eliminating the need for water treatment operations at the surface to separate the oil from other subterranean fluids. A subterranean cavern formed by a system or method according to the present disclosure can be used to dispose of or store carbon dioxide and/or water produced from the surrounding subterranean formation.

The details of one or more implementations of the disclosure are set forth in the accompanying drawings and the description below. Other features, objects, and advantages of the disclosure will be apparent from the description and drawings, and from the claims.

DETAILED DESCRIPTION

The present disclosure describes a method and system for forming a subterranean cavern for oil production. In some implementations, the method and system provide for improved production of oil from a subterranean formation. This disclosure describes a system for forming a subterranean cavern in a wellbore and pumping oil from an oil column formed in the subterranean cavern to the surface. For example, an acidizing tool coupled to an acid source is lowered into a wellbore and is operated to spray acid onto an inner wall of the wellbore. The acid applied to the inner wall of the wellbore increases the radius of the portion of the wellbore proximate the acidizing tool to form a subterranean cavern. Formation fluid from the subterranean formation surrounding the subterranean cavern flows into the subterranean cavern. The formation fluid in the subterranean cavern separates under gravity separation into an oil column and water column. In order to pump oil from the subterranean cavern, a submersible pump is lowered into the subterranean cavern and positioned in the center of the oil column based on signals received from a liquid level sensor. Once positioned in the center of the oil column, the submersible pump is operated to pump the oil in the subterranean cavern to the surface while minimizing the water and other formation fluids pumped to the surface.

Figure 1:
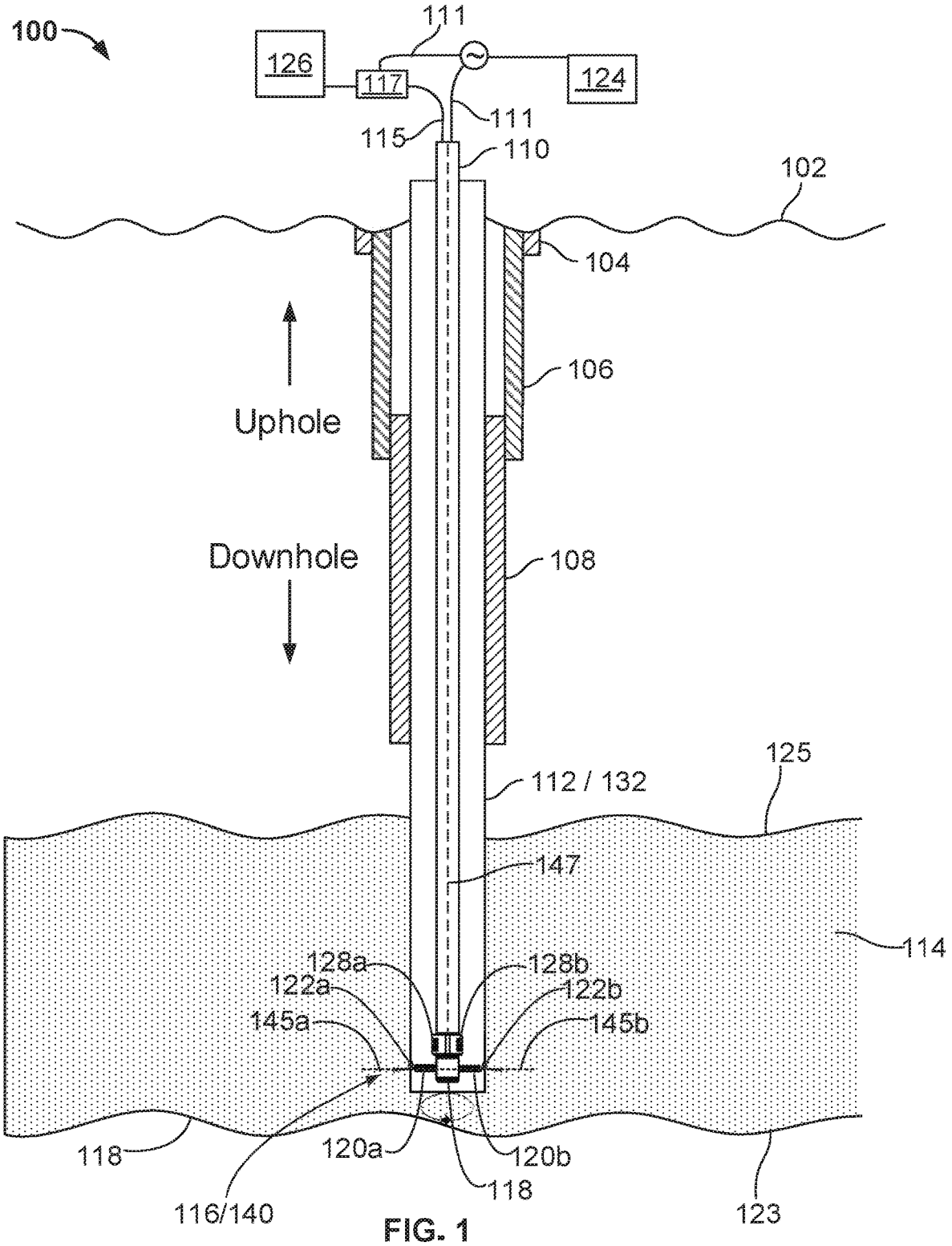
FIG. 1 is a schematic illustration of an example system for forming a subterranean cavern according to the present disclosure.

FIG. 1 is a schematic illustration of an example system 100 for forming a subterranean cavern. As depicted in FIG. 1, the system 100 includes an acidizing tool 116, a downhole conveyance 110, a control system 124, and an acid source 126. As illustrated in FIG. 1, the downhole conveyance 110 is operable to convey (for example, run in, or pull out, or both) the acidizing tool 116 through a wellbore 112.

Although not shown, a drilling assembly deployed on the surface 102 can be used to form the wellbore 112 prior running the acidizing tool 116 into the wellbore 112 to form a subterranean cavern. The wellbore 112 is formed to extend from the surface 102 through one or more geological formations in the Earth. One or more subterranean formations, such as subterranean zone 114, are located under the surface 102. One or more wellbore casings, such as surface casing 106 and intermediate casing 108, can be installed in at least a portion of the wellbore 112. In some implementations, the well can be uncased.

Although shown as a wellbore 112 that extends from land, the wellbore 112 can be formed under a body of water rather than the surface 102. For instance, in some implementations, the surface 102 can be a surface under an ocean, gulf, sea, or any other body of water under which hydrocarbon-bearing, or water-bearing, formations can be found. In short, reference to the surface 102 includes both land and underwater surfaces and contemplates forming or developing (or both) one or more wellbores 112 from either or both locations.

The wellbore 112 can be formed by any appropriate assembly or drilling rig used to form wellbores or boreholes in the Earth. Although shown as a substantially vertical wellbore (for example, accounting for drilling imperfections), the wellbore 112, in alternative implementations, can be directional, horizontal, curved, multi-lateral, or other form other than merely vertical.

Once the wellbore 112 is formed (or in some cases during portions of forming the wellbore 112), one or more tubular casings can be installed in the wellbore 112. As illustrated, the wellbore 112 includes a conductor casing 104, which extends from the surface 102 shortly into the Earth. A portion of the wellbore portion 112 enclosed by the conductor casing 104 can be a borehole.

Downhole of the conductor casing 104 is the surface casing 106. The surface casing 106 can enclose a borehole that is smaller than the borehole enclosed by the conductor casing 104 and can protect the wellbore 112 from intrusion of, for example, freshwater aquifers located near the surface 102. The wellbore 112 then extends vertically downward. This portion of the wellbore 112 can be enclosed by the intermediate casing 108. In some implementations, the location in the wellbore 112 at which the acidizing tool 116 is moved to can be an open hole portion (for example, with no casing present) of the wellbore 112. As depicted in FIG. 1, the subterranean zone 114 has a lower end 123 and an upper end 125 that together define a thickness of the subterranean zone 114. As can be seen in FIG. 1, the lower end 123 is farther away from the surface 102 (that is further downhole) than the upper end 125. In some implementations, the open hole portion of the wellbore 112 is proximate the lower end 123 of the subterranean zone 114.

As depicted in FIG. 1, the acidizing tool 116 is coupled (for example, threadingly or through another connection) to the downhole conveyance 110. In some implementations, the downhole conveyance 110 can be a tubular work string made up of multiple tubing joints. For example, a tubular work string typically consists of sections of steel pipe, which are threaded so that they can interlock together. In alternative implementations, the downhole conveyance 110 can be a wireline. In some examples, the downhole conveyance 110 can be an e-line. As described in further detail herein, the acidizing tool 116 can be positioned in the wellbore 112 using the downhole conveyance 110, and rotated about the downhole conveyance 110 to apply acid to an inner wall 132 of the wellbore 112.

As shown in FIG. 1, the acidizing tool includes a hub 118, and a pair of projections 120*a*, 120*b* extending from the hub 118. Each of the projections 120*a*, 120*b* includes an opening 122*a*, 122*b* at the end of the respective projection 120*a*, 120*b*. As will be described in further detail herein, acid supplied to the acidizing tool 116 exits the acidizing tool 116 through the openings 122*a*, 122*b* of the projections 120*a*, 120*b*, and is applied to portions of the inner wall 132 of the wellbore 112 proximate the acidizing tool 116. In some implementations, the acidizing tool 116 includes one or more spray jets (not shown) coupled to the openings 122*a*, 122*b* to spray and distribute the acid provided to the acidizing tool 116 and exiting the openings 122*a*, 122*b*.

While the acidizing tool 116 has been described as including a pair of projections 120*a*, 120*b* extending from a hub 118, other shapes and designs can be used for the acidizing tool. For example, in some implementations, the acidizing tool 116 can include three or more projections extending from a hub. Further, in some implementations, the projections 120*a*, 120*b* can each include two or more of openings positioned along the length of each projection 120*a*, 120*b*.

In some implementations, the acidizing tool 116 does not include any projections 120*a*, 120*b*. For example, in some implementations, the acidizing tool includes a body with a plurality of openings extending through the body, and the body of the acidizing tool is configured to rotate about the downhole conveyance 110 and provide acid to the wellbore 112 through the opening in the body of the acidizing tool.

As depicted in FIG. 1, the system also includes an acid source 126. The acid source 126 is fluidly coupled to the acidizing tool 116 by a fluid line 115. In some examples, the fluid line 115 includes coiled tubing, and acid is supplied to the acidizing tool 116 from the acid source 126 via coiled tubing coupled to the acid source 126 and the acidizing tool 116. In addition, the system includes a pump 117 fluidly coupled to the acid source 126. The pump 117 is configured to pump acid from the acid source 126 through the fluid line 115 to the acidizing tool 116. The pressure provided by the pump 117 can be adjusted to control the pressure of the acid exiting the openings 122*a*, 122*b* of the acidizing tool 116. Any suitable type of pump, such as a positive displacement pump, can be used to pump acid from the acid source 126 to the acidizing tool 116. The pump 117 is made of a material resistant to acid corrosion, such as stainless steel.

The system 100 also includes an array of sensors 128*a*, 128*b* used to measure the radius of the portion of the wellbore 112 proximate to and surrounding the acidizing tool 116. As depicted in FIG. 1, the sensors 128*a*, 128*b* are coupled to the hub 118 of the acidizing tool 116. Any suitable sensors for measuring the radius of the wellbore 112, such as ultrasonic sensors, laser measurement sensors, etc., can be used. In some implementations, the sensors 128*a*, 128*b* can also be used to measure a depth of the wellbore 112. In some implementations, the sensors 128*a*, 128*b* include an emitter and a receptor, and the radius of the wellbore 112 surrounding the acidizing tool is measured by the emitter on each of the sensors 128*a*, 128*b* emitting an ultrasonic wave or a laser beam, which is reflected against the inner wall 132 of the wellbore 112 and the reflected wave or beam is detected by the receiver of each of the respective sensors 128*a*, 128*b*. The radius of the wellbore 112 can be determined based on the time elapsed between the emission of the wave or beam and the reception of the reflected wave or beam. For example, based on the speed of light, the distance traveled by a laser beam emitted by the sensors 128*a*, 128*b* and reflected off the inner wall 132 back to the sensors 128*a*, 128*b* can be determined, indicating the distance between the sensors 128*a*, 128*b* and the inner wall 132 of the wellbore 112, which can be used to determine the radius of the wellbore 112. Similarly, based on the speed of sound, the distance travelled by an ultrasonic wave emitted by the sensors 128*a*, 128*b* and reflected off the inner wall 132 back to the sensors 128*a*, 128*b* can be determined, which indicates the distance between the sensors 128*a*, 128*b* and the inner wall 132 of the wellbore 112, which can be used to determine the radius of the wellbore 112. In some implementations, a single sensor can be used to detect the radius of the wellbore.

While the sensors 128*a*, 128*b* for detecting the radius of the wellbore 112 are depicted in FIG. 1 as being coupled to the acidizing tool 116, in some implementations, the sensors 128*a*, 128*b* can be separate from the acidizing tool 116 and conveyed into the wellbore 112 separately using a downhole conveyance.

As shown in FIG. 1, the system 100 also includes a control system 124 communicably coupled to the pump 117, the acidizing tool 116, and the array of sensors 128*a*, 128*b*. As illustrated in FIG. 1, the acidizing tool 116, the array of sensors 128*a*, 128*b*, and the pump 117 are each coupled through a control line 111 to the control system 124, which, in this example, is located at the surface 102. The control line 111 can work in conjunction with the control system 123 to communicate both power and data. In some embodiments, separate electrical lines are used to provide power and communicate data. The control system 124 can be a microprocessor-based, mechanical, or electromechanical controller, as some examples. The controller 124 can be implemented as a computer system that includes one or more processors and a computer-readable medium storing instructions executable by the one or more processors to perform operations described here. Alternatively or in addition, the controller 124 can be implemented as processing circuitry, firmware, hardware, software or combinations of them with or independent of the computer system.

The control system 124, in some implementations, can send and receive data between itself and the sensors 128*a*, 128*b* and the acidizing tool 116. The control system 124 includes a power source, such as a battery, and, in some implementations, the control system 124 provides electrical power to the acidizing tool 116. In addition, the control system 124 can control and provide electrical power to the pump 117. In some implementations, power is provided to the acidizing tool 116 via power cables extending from the surface 102 through the wellbore 112 to the acidizing tool 116. In some implementations, a single electrical line (such as control line 111) can be used to provide both power and data transmission to the acidizing tool 116, pump 117, and sensors 128*a*, 128*b*. In some implementations, separate electrical lines are used to provide data communication and power to the acidizing tool 116, pump 117, and sensors 128*a*, 128*b*. In some implementations, the sensors 128*a*, 128*b* are battery powered. The control system 124 can perform one or more operations described in the present disclosure to operate all or parts of the acidizing tool 116, the sensors 128*a*, 128*b*, and the pump 117.

Referring to FIGS. 1-6 and 9, a method of forming a subterranean cavern for oil production will now be described. At 602, a wellbore is formed in a subterranean zone. For example, as depicted in FIG. 1, a wellbore 112 is formed from a surface 102 to a subterranean zone 114. As depicted in FIG. 1, an open hole portion of the wellbore 112 passes through a subterranean zone 114 containing formation fluids, such as liquid hydrocarbons. Oil is an example of a liquid hydrocarbon that can be contained in the subterranean formation 114.

Once the wellbore 112 is formed, acid is sprayed onto an inner wall of the wellbore 112 to form a subterranean cavern (150). As depicted in FIG. 1, an acidizing tool 116 is continually lowered downhole through the wellbore 112 until the acidizing tool 116 is positioned within an open hole portion of the wellbore 112 adjacent the subterranean formation 114. For example, the control system 124 controls the movement of the downhole conveyance 110 coupled to the acidizing tool 116 to lower the acidizing tool 116 into the wellbore 112 a predetermined distance that corresponds with to a portion of the wellbore 112 adjacent the subterranean formation 114. In some implementations, the subterranean formation 114 contains carbonate formations, which are susceptible to acid etching.

As depicted in FIG. 1, the acidizing tool 116 is positioned proximate an inner wall 132 of the wellbore 112 without touching the inner wall 132 of the wellbore 112. In addition, as depicted in FIG. 1, the acidizing tool 116 is positioned within the wellbore 112 proximate the lower end 123 of the subterranean zone 114. Further, as depicted in FIG. 1, the acidizing tool 116 is oriented in a first position 140 within the wellbore 112 such that the longitudinal axis 145*a*, 145*b* of each of the projections 120*a*, 120*b* of the acidizing tool 116 is substantially perpendicular to the longitudinal axis 147 of the downhole conveyance 110 and the inner wall 132 of the wellbore 112. In some implementations, the longitudinal axis 145*a*, 145*b* of each of the projections 120*a*, 120*b* is at an angle ranging from about 0 degrees to about 90 degrees relative to the longitudinal axis 147 of the downhole conveyance 110 and the inner wall 132 of the wellbore 112. Changing the angle of the projections 120*a*, 120*b* relative to the longitudinal axis 147 of the downhole conveyance 110 and the wellbore 112 alters the shape of the subterranean cavern 150 formed by the acidizing tool 116. Once the acidizing tool 116 is positioned within the wellbore 112 adjacent the subterranean formation 114, a process for forming a subterranean cavern can be initiated using the control system 124. For example, once the acidizing tool 116 is positioned within the wellbore 112 adjacent the subterranean formation 114, the control system 124 engages the pump 117 coupled to the acid source 126 to pump acid from the acid source 126 through the fluid line 115 to the acidizing tool 116. In some implementations, the depth of the acidizing tool 116 within the wellbore 112 is determined by the control system 124 based on signals received from one or more sensors (not shown) that indicate the number of turns that a reel coupled to the downhole conveyance 110 has completed. Based on the number of turns completed by the reel coupled to the downhole conveyance 110, the control system 124 can determine the length of the downhole conveyance 120 within the wellbore 112, which indicates the depth of the acidizing tool 116 within the wellbore 112.

Acid pumped from the acid source 126 to the acidizing tool 116 by pump 117 exits the acidizing tool 116 and is sprayed onto the inner wall 132 of the wellbore 112. For example, the acid pumped from the acid source 126 to the acidizing tool 116 exits the acidizing tool 116 through the openings 122*a*, 122*b* of projections 120*a*, 120*b* of the acidizing tool 116. In some implementations, based on the radius of the wellbore 112 detected by sensors 128*a*, 128*b*, the control system 124 determines the pressure of the acid exiting the openings 122*a*, 122*b* of the acidizing tool 116 required for the acid to reach the inner wall 132 of the wellbore 112. Based upon this determination, the control system 124 controls the pump 117 to generate sufficient fluid pressure in the fluid line 115 to provide the necessary pressure for the acid exiting the acidizing tool 116 to reach the inner wall 132 of the wellbore 112.

While acid is being pumped from the acid source 126 to the acidizing tool 116, the control system 124 controls the acidizing tool 116 to rotate within the wellbore 112. For example, the control system 124 controls the hub 118 of the acidizing tool 116 to rotate 360 degrees about the end of downhole conveyance 110. By rotating the acidizing tool 116 within the wellbore 112, the acid exiting the openings 122*a*, 122*b* of the acidizing tool 116 is distributed substantially evenly onto the inner wall 132 of the wellbore 112. In some implementations, the control system 124 controls the rate of rotation of the acidizing tool 116 within the wellbore 112. In addition, the control system 124 controls the fluid pressure provided by the pump 117 in order to control the rate of ejection of acid from the acidizing tool 116

Figure 2:
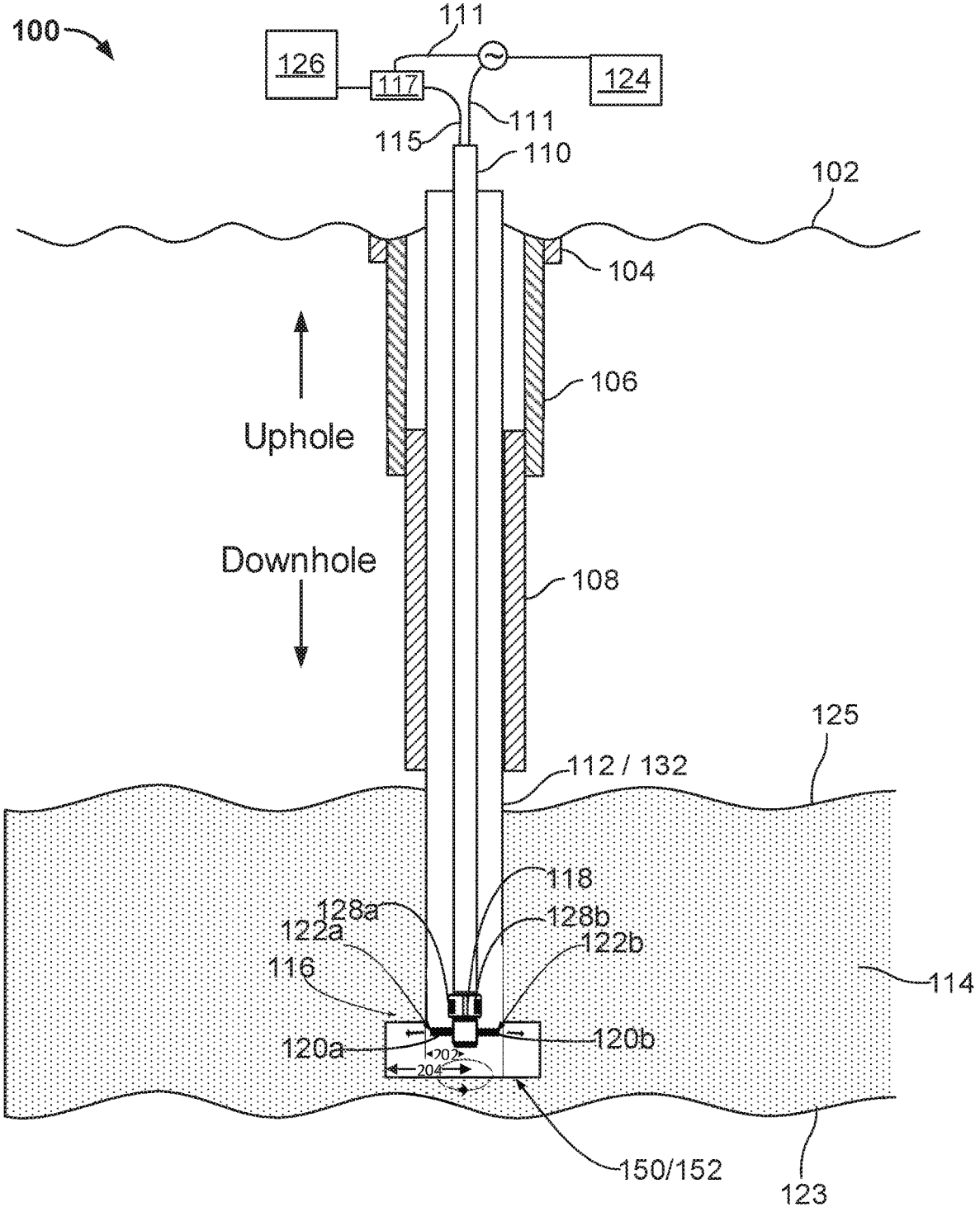
FIGS. 2-6 depict a process for forming a subterranean cavern.

As acid is applied by the acidizing tool 116 to the inner wall 132 of the wellbore 112, the acid erodes the portion of the subterranean formation 114 forming the inner wall 132. As a result, the radius of the wellbore 112 proximate the acidizing tool 116 increases to form a portion of a subterranean cavern. For example, as depicted in FIG. 2, the wellbore 112 has an initial radius 202 prior to application of acid to the inner wall 132 of the wellbore 112 by the acidizing tool 116. As acid is continually applied to the inner wall 132, the radius of the wellbore 112 gradually increases to a target radius 204. In some implementations, the target radius 204 is about 600 percent to about 800 percent the initial radius 202 of the wellbore 112. In some implementations, the target radius 204 is equal to about 300 percent to about 400 percent the initial radius 202 of the wellbore 112. Any suitable type of acid, such as hydrochloric acid can be used to increase the radius of the wellbore to form the subterranean cavern 150.

As the acidizing tool 116 applies acid to the inner wall 132 of the wellbore 112, the sensors 128*a*, 128*b* coupled to the acidizing tool 116 continually measure the radius of the wellbore 112 and transmit signals to the control system 124 indicating the current radius of the wellbore 112. In some implementations, the sensors 128*a*, 128*b* are configured to transmit signals to the control system 124 in realtime. Realtime monitoring allows continuous monitoring to better control the subterranean cavern formation process.

For the purposes of this disclosure, the terms "real-time," "real time," "realtime," "real (fast) time (RFT)," "near(ly) real-time (NRT)," "quasi real-time," or similar terms (as understood by one of ordinary skill in the art) mean that an action and a response are temporally proximate such that an individual perceives the action and the response occurring substantially simultaneously. For example, the time difference for a response to display (or for an initiation of a display) of data following the individual's action to access the data may be less than 1 ms, less than 1 sec., less than 5 secs., etc. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit (or a combination of these or other functions) the data.

In some implementations, as the radius of the wellbore 112 increases due to the acid etching performed by the acidizing tool 116, the control system 124 controls the pump 117 to adjust fluid pressure of the acid provided to the acidizing tool 116. For example, if the signals provided by the sensors 128*a*, 128*b* indicate that the radius of the wellbore 112 proximate the acidizing tool 116 has increased, the control system 124 can cause the pump 117 to provide an increased fluid pressure in the fluid line 115 such that the acid exits the openings 122*a*, 122*b* of the acidizing tool 116 at an increased rate of ejection. Continually increasing the fluid pressure of the acid provided to the acidizing tool 116 as the radius of the wellbore 112 increases ensures the acid exiting the acidizing tool 116 is still able to reach the inner wall 132 of the wellbore 112.

Figure 3:
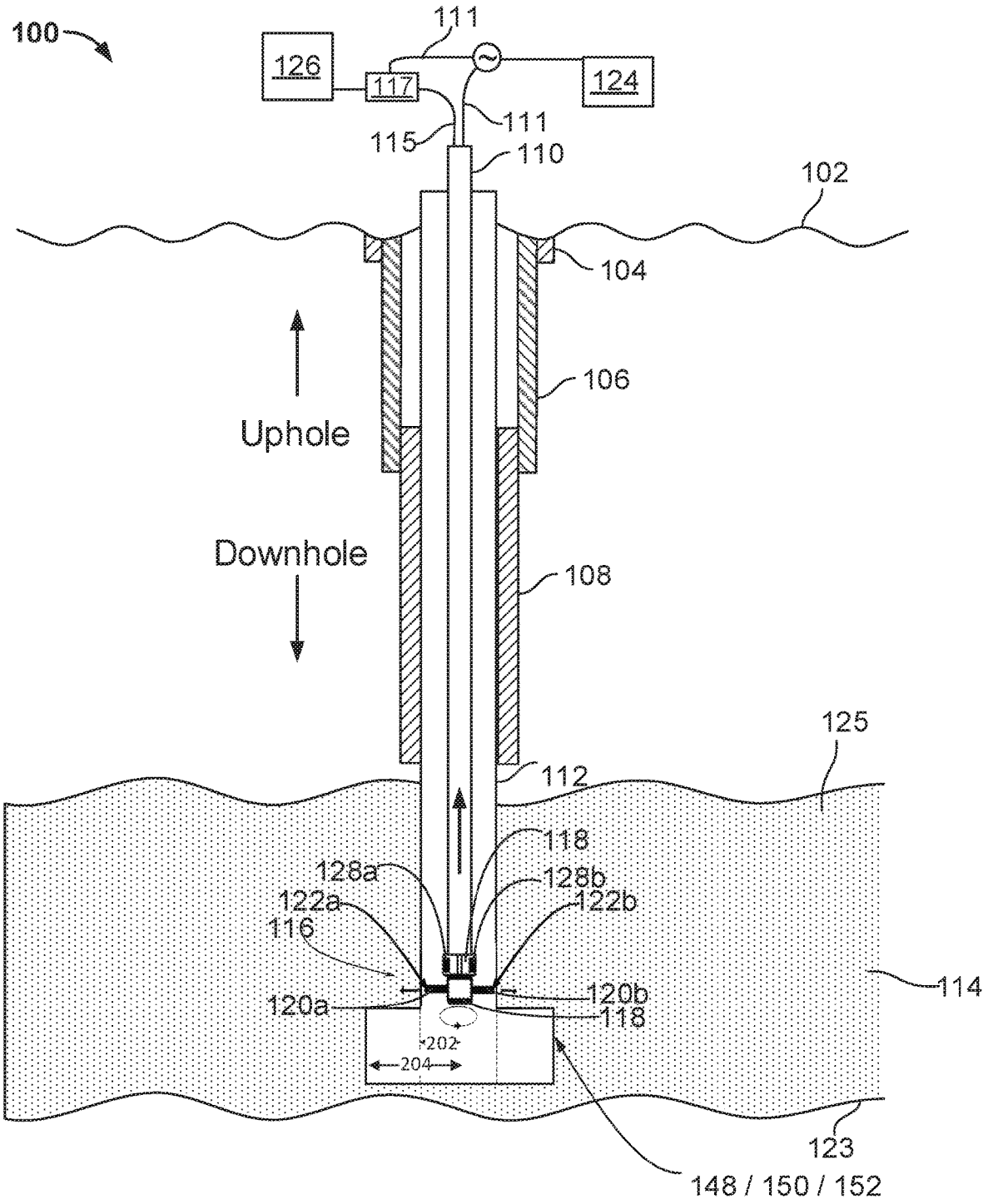

Referring to FIG. 3, once the control system 124 receives a signal from the sensors 128*a*, 128*b* indicating that radius of the wellbore 112 is equal to a target radius 204, the control system 124 controls the acidizing tool 116 to reposition the acidizing tool 116 in a portion of the wellbore 112 uphole from the previously etched portion 148 of the wellbore 112 that has a target radius 204. For example, as depicted in FIG. 3, once the control system 124 receives a signal from the sensors 128*a*, 128*b* indicating that the radius of the wellbore 112 proximate the acidizing tool 116 has reached a target radius 204, the control system 124 controls the downhole conveyance 110 to raise the acidizing tool 116 uphole to a portion of the wellbore 112 with a radius smaller than the target radius 204, as detected by sensors 128*a*, 128*b*. The downhole conveyance 110 coupled to the acidizing tool 116 is controlled by the control system 124 to lower and raise the acidizing tool 116 through the wellbore 112. In some implementations, in response to receiving a signal from sensors 128*a*, 128*b* indicating that the radius of the wellbore 112 proximate the acidizing tool 116 has reached a target radius 204, the control system 124 causes the acidizing tool 116 to be raised until the control system 124 receives a signal from the sensors 128*a*, 128*b* indicating that the radius of the wellbore 112 is less than the target radius 204. In some implementations, the acidizing tool 116 is moved uphole at a predefined rate.

The acidizing tool 116 is continually moved uphole through the wellbore 112 while spraying acid onto the inner wall 132 of the wellbore 112, as described above, in order to form a lower portion 152 of a subterranean cavern 150, as depicted in FIG. 3. For example, the acidizing tool 116 is continually moved uphole within the wellbore 112 while spraying acid onto the inner wall 132 of the wellbore 112 until the control system 124 determines that the acidizing tool 116 has moved uphole by a predetermined distance to form a lower portion 152 of a subterranean cavern 150 with a predefined depth. In some examples, the acidizing tool 116 is moved uphole to form a subterranean cavern 150 with a lower portion 152 that has a depth equal to about 30 percent to about 50 percent of the total depth of the wellbore 112. In some implementations, the lower portion 152 that has a depth equal to about 20 percent to about 60 percent of the total depth of the wellbore 112. In some implementations, the lower portion 152 of the subterranean cavern 150 has a depth equal to the thickness of the oil-bearing subterranean formation 114. In some implementations, the lower portion 152 of the subterranean cavern 150 is reinforced with casing positioned along the inner walls of the lower portion 152 of the subterranean cavern 150.

Figure 4:
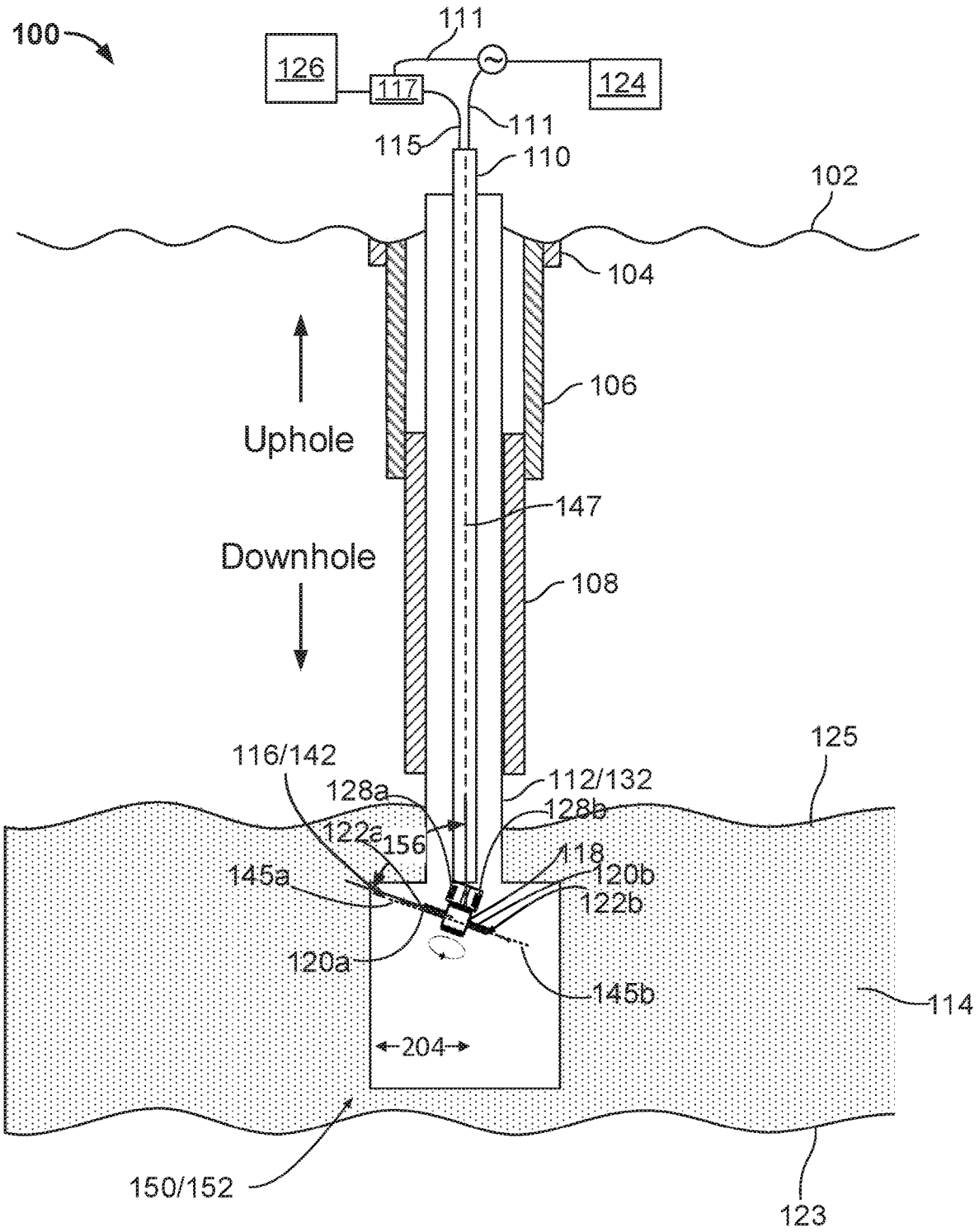

Referring to FIG. 4, once the control system 124 determines that the acidizing tool 116 has been moved uphole within the wellbore 112 by a predetermined distance to a form a lower portion 152 of the subterranean cavern 150, the control system 124 controls the acidizing tool 116 to rotate and adjust position relative to the downhole conveyance 110 to form a dome-shaped upper portion 154. For example, as previously discussed, when forming the lower portion 152 of the subterranean cavern, the acidizing tool 116 is in a first position 140 with the longitudinal axis 145*a*, 145*b* of each of the projections 120*a*, 120*b* of the acidizing tool 116 substantially perpendicular to the longitudinal axis 147 of the downhole conveyance 110 and the longitudinal axis of the wellbore 112. As depicted in FIG. 4, in order to form a dome-shaped upper portion 154 of the subterranean cavern 150, the control system 124 controls the acidizing tool 116 to move at an angle relative to the downhole conveyance 110 and longitudinal axis of the wellbore 112.

Figure 5:
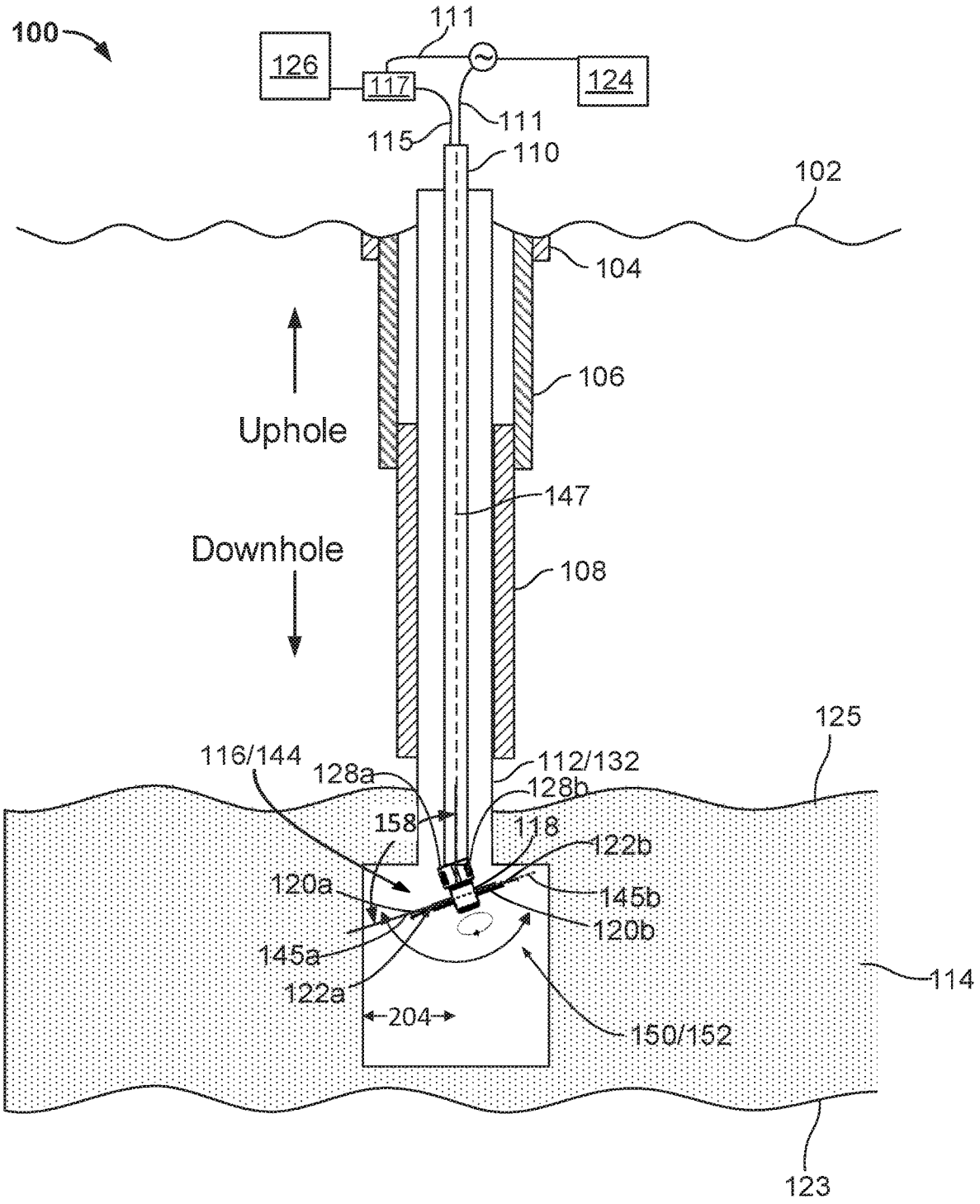
Figure 6:
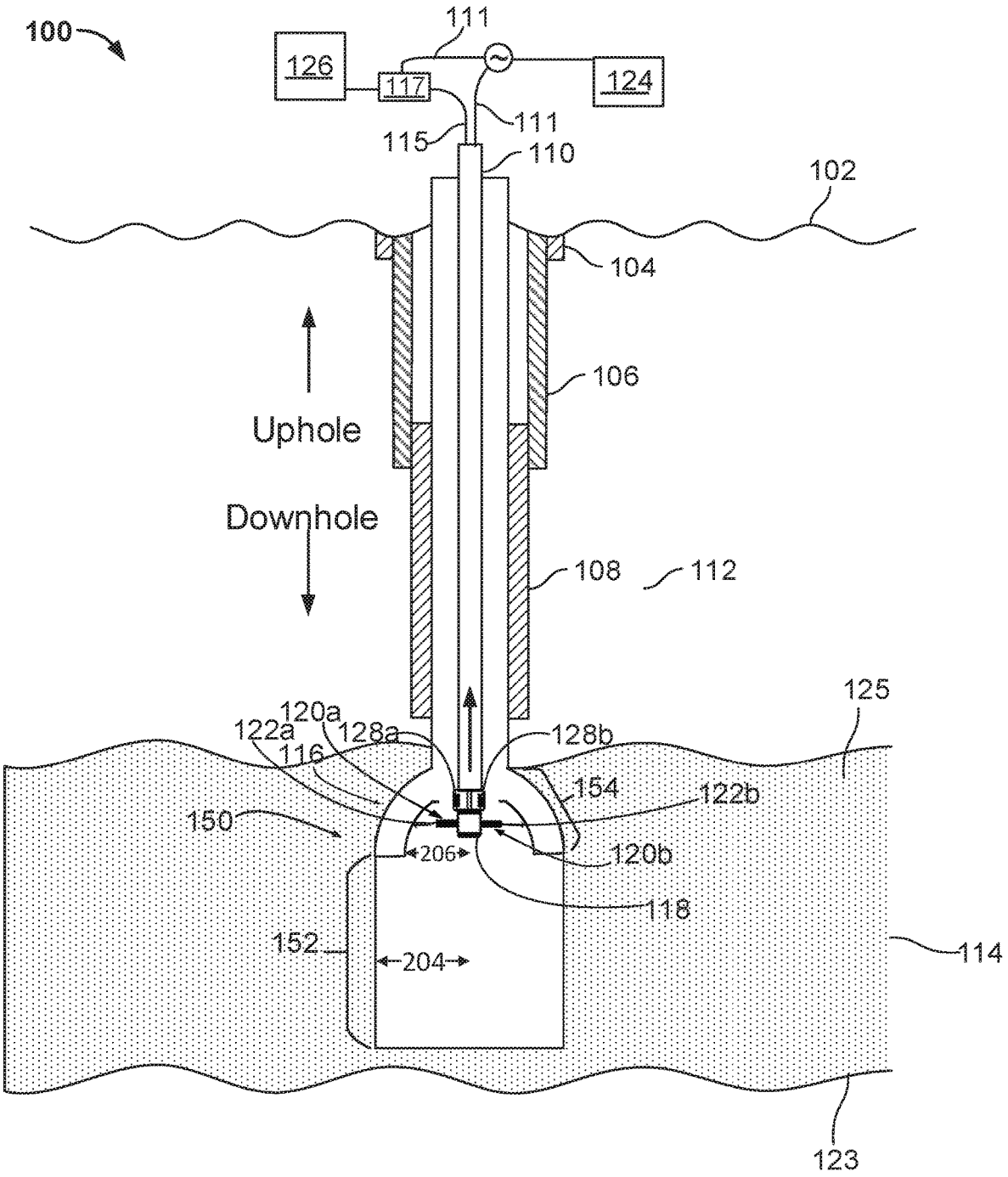

In some implementations, in order to form the dome-shaped upper portion 154 of the subterranean cavern 150 (as depicted in FIG. 6) the acidizing tool 116 moves between a first angular position 142 (depicted in FIG. 4) and a second angular position 144 (depicted in FIG. 5). In some implementations, the angle 156 of the longitudinal axis 145*a* of projection 120*a* is about 45 degrees relative to the longitudinal axis of the wellbore 112 and the longitudinal axis 147 of the downhole conveyance 110 in the first angular position 142 and the angle 158 of the longitudinal axis 145*a* of projection 120*a* is about 135 degrees relative to the longitudinal axis of the wellbore 112 and the longitudinal axis 147 of the downhole conveyance 110 in the second angular position. In some implementations, the longitudinal axis 145*a*, 145*b* of each of the projections 120*a*, 120*b* is substantially parallel to the longitudinal axis of the wellbore 112 when the acidizing tool 116 is in either the first angular position 142 or the second angular positions 144. In some implementations, the longitudinal axis 145*a*, 145*b* of each of the projections 120*a*, 120*b* can range from about 20 degrees to about 160 degrees relative the longitudinal axis of the wellbore 112 and the longitudinal axis 147 of the downhole conveyance 110.

While the acidizing tool 116 is moving between the first angular position 142 and the second angular position 144, the control system 124 continues to control the pump 117 to pump acid from the acid source 126 to the acidizing tool 116 via the fluid line 115. In addition, the acidizing tool 116 continues to rotate about the end of the downhole conveyance 110 and spray acid onto the inner wall 132 of the wellbore 112.

The sensors 128*a*, 128*b* continually measure the radius 206 of the dome-shaped upper portion 154 of the subterranean cavern 150 as it is being formed by the acidizing tool 116, and transmit signals to the control system 124 indicating the radius 206 of the upper portion 154. Once the control system 124 receives a signal from the sensors 128*a*, 128*b* indicating that the radius 206 of the dome-shaped upper portion 154 of the subterranean cavern 150 is equal to a target radius, the control system 124 ceases movement of the acidizing tool 116 and controls the pump 117 to stop the flow of acid to the acidizing tool 116.

In some implementations, the dome shape of the upper portion 154 of the subterranean cavern 150 is configured to prevent the subterranean cavern 150 from collapsing. For example, based on rock elasticity theory, the crown of the dome-shaped upper portion 154 ("roof") of the subterranean cavern 150 experiences the maximum tangential stress of the upper portion 154. However, as depicted in FIG. 6, the crown of the dome-shaped roof 154 is removed and open to the wellbore 112, thus reducing the tangential stress on the subterranean cavern 150. The size of the opening through the dome-shaped upper portion 154 can be predetermined based on the mechanical properties of the subterranean formation 114 and the in situ stress contrast. In some implementations, the upper portion 154 of the subterranean cavern 150 is reinforced with a casing shoe (not shown) to improve resistance of the upper portion 154 against compressional loading. The casing shoe can be placed above the cap rock. The cap rock is the dome-like roof created above the cavern. Anhydrate formation is an example of a cap rock.

As depicted in FIG. 6, once the radius 206 of dome-shaped upper portion 154 of the subterranean cavern 150 is equal to a predetermined target radius and the control system 124 has stopped the pump 117 from pumping additional acid to the acidizing tool 116, the acidizing tool 116 is withdrawn from the subterranean cavern 150 uphole through the wellbore 112 to the surface 102. As depicted in FIG. 6, the wellbore 112 fluidly connects the subterranean cavern 150 with the surface 102.

Figure 7:
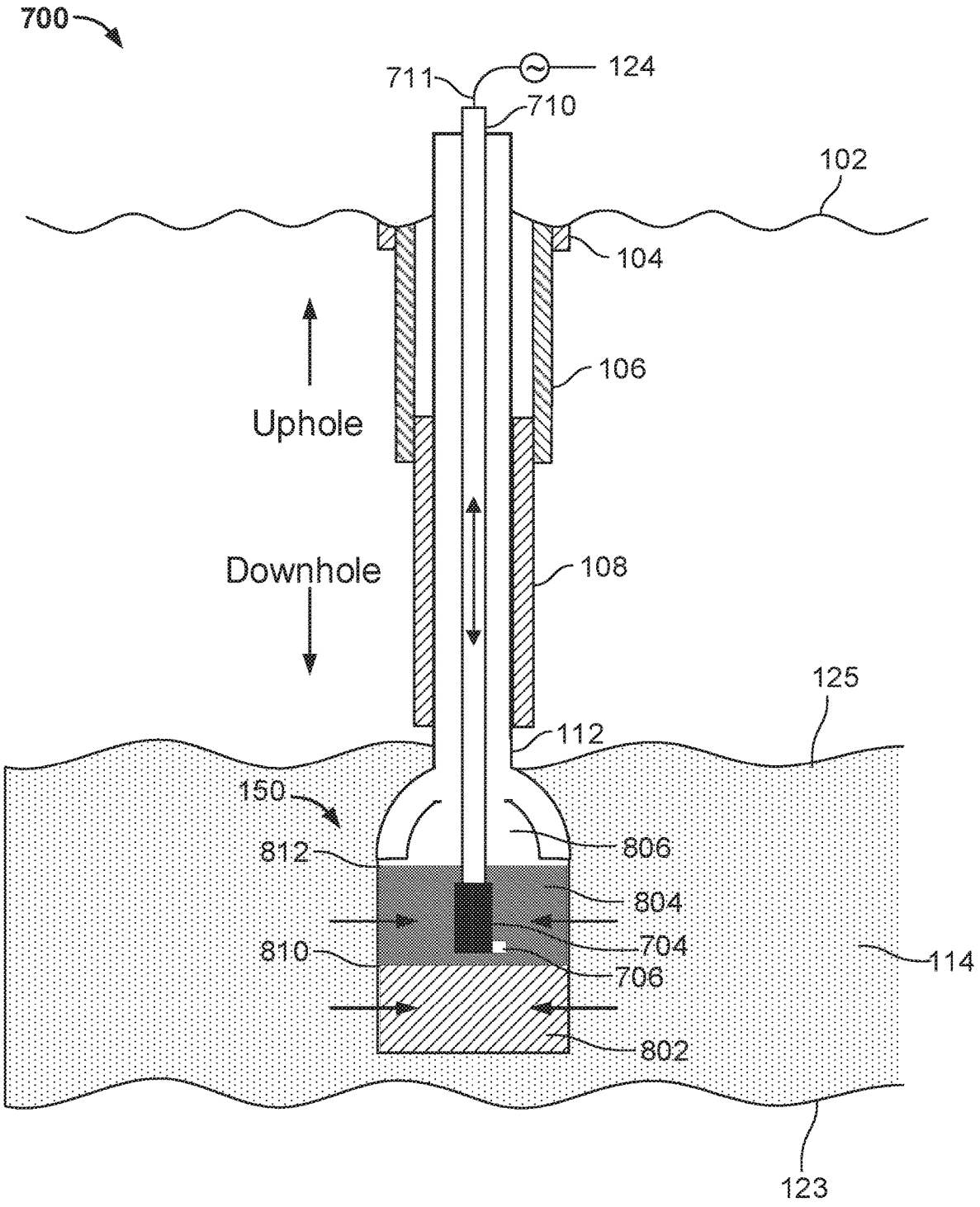
FIGS. 7 and 8 depict a process for pumping oil from a subterranean cavern.
Figure 8:
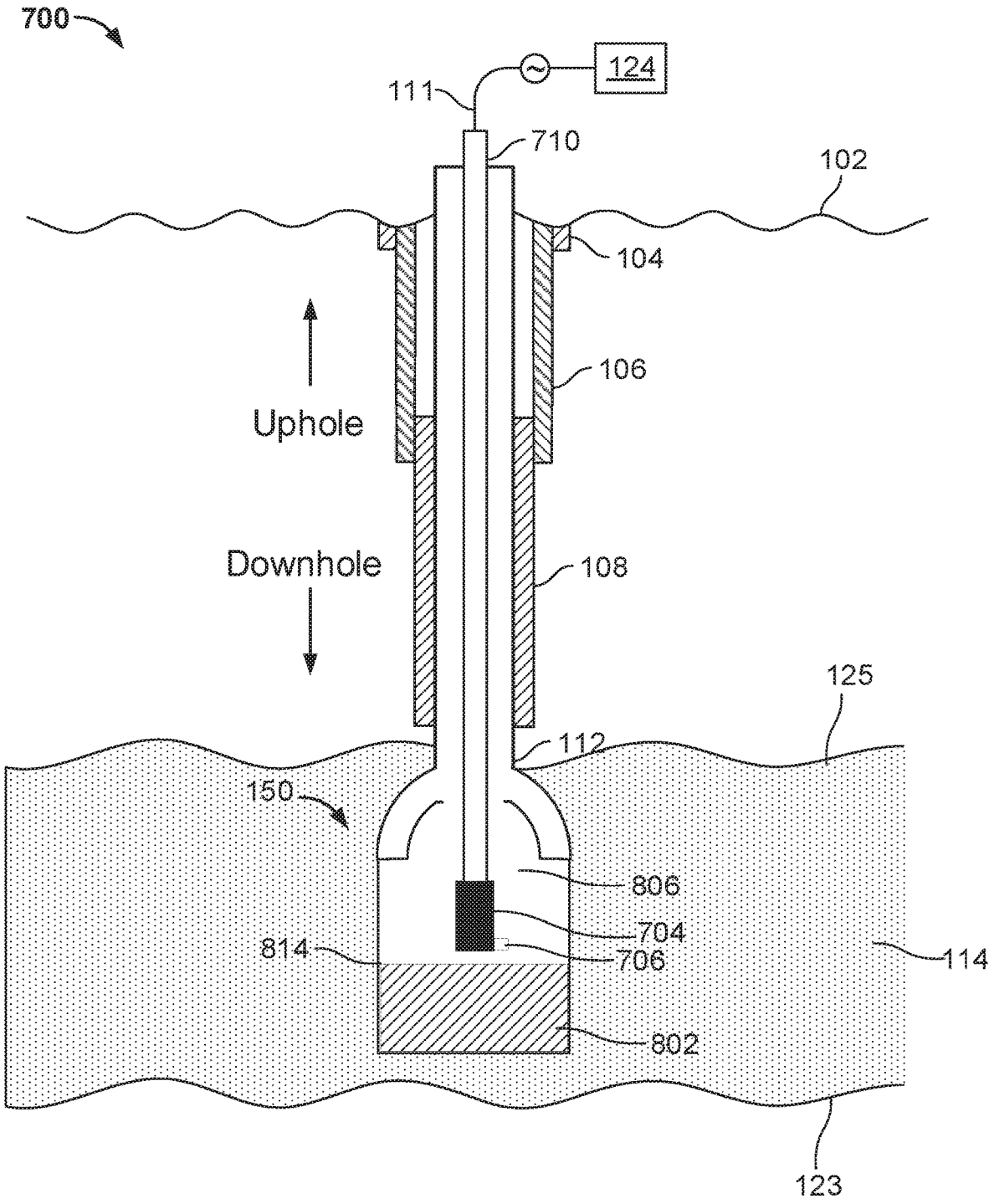
Figure 9:
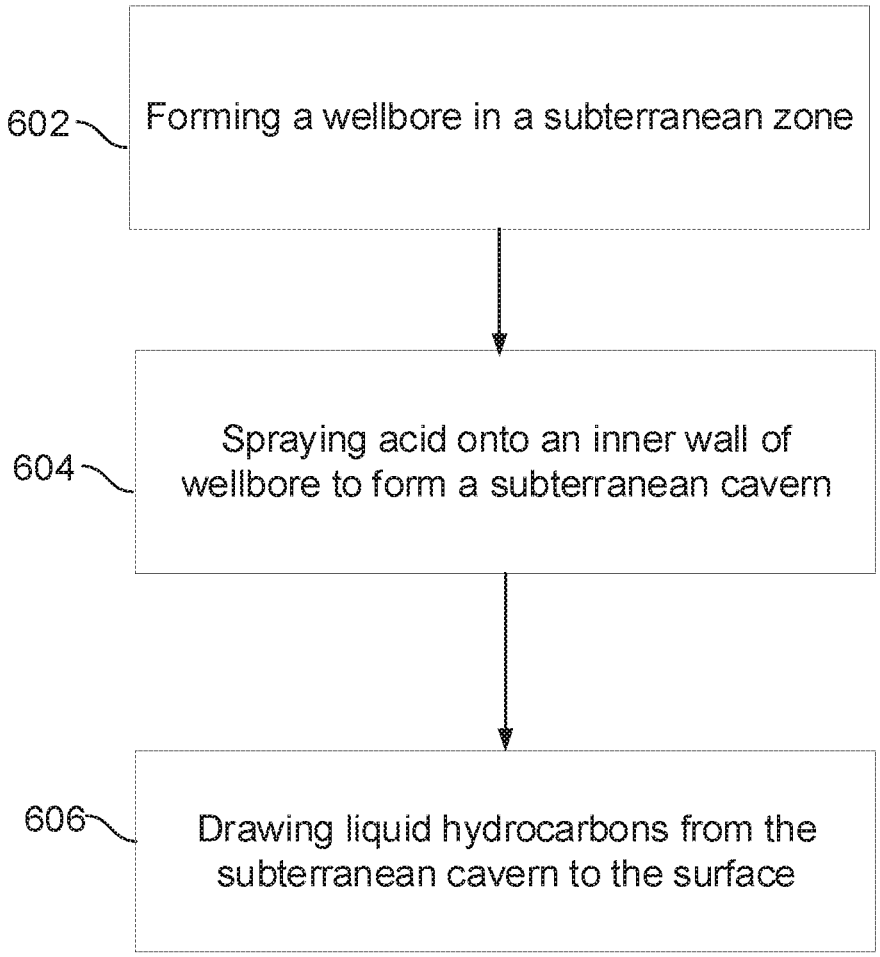
FIG. 9 is a flowchart of an example process of forming a subterranean cavern.

At 606, liquid hydrocarbons are drawn from the subterranean cavern to the surface. Referring to FIGS. 7-9, a system and method for removing fluids from the subterranean cavern 150 will now be described. As depicted in FIG. 7, the system 700 for removing fluid from the subterranean cavern includes a submersible pump 704, a liquid level sensor 706, a downhole conveyance 710, and the control system 124. Any suitable type of submersible pump, such as a positive displacement pump, can be used to pump fluids, such as formation fluids, from the subterranean cavern 150 to the surface 102. The submersible pump 704 is made of a material resistant to acid corrosion, such as stainless steel.

As depicted in FIG. 7, the submersible pump 704 is coupled to a downhole conveyance 710 and is raised and lowered within the wellbore 112 and subterranean cavern 150 by raising and lowering the downhole conveyance 710. In some implementations, the downhole conveyance 710 can be a tubular work string made up of multiple tubing joints. For example, a tubular work string typically consists of sections of steel pipe, which are threaded so that they can interlock together. In alternative implementations, the downhole conveyance 710 can be a wireline. In some examples, the downhole conveyance 110 can be an e-line.

As depicted in FIG. 7, a liquid level sensor 706 is coupled to the submersible pump 704. The liquid level sensor 706 can be configured to detect fluid interfaces, such as oil-water interfaces, oil-gas interfaces, and water-gas interfaces. The liquid level sensor 706 can be any suitable sensor, such as an ultrasonic sensor. For example, the liquid level sensor 706 can be an ultrasonic sensor that emits pulse sound waves. The sound waves emitted by the liquid level sensor 706 are reflected off the liquid interfaces in the subterranean cavern 150 and received by the liquid level sensor 706. The reflected sound waves detected by the liquid level sensor 706 can be used to determine the presence and depth of the liquid interfaces.

While the liquid level sensor 706 is depicted in FIGS. 7 and 8 as being coupled to the submersible pump 704, in some implementations, the liquid level sensor 706 can be separate from the submersible pump 704 and conveyed into the wellbore 112 separately using a downhole conveyance As depicted in FIG. 7, the submersible pump 704 and the liquid level sensor 706 are coupled to the control system 124 through a control line 711. The control system 124, in some implementations, can send and receive data between it and the submersible pump 704 and the liquid level sensor 706, as well as, for example, provide electrical power to the submersible pump 704. The control system 124 can perform one or more operations described in the present disclosure to operate all or parts of the submersible pump 704 and the liquid level sensor 706. The control system 124 controls the operation of the submersible pump 704 to remove fluids from the subterranean cavern 150.

Referring to FIG. 7, formation fluids from the surrounding subterranean formation 114 flow into and fill the subterranean cavern 150. The increased radius 204 of the subterranean cavern 150 compared to the initial radius 202 of the wellbore 112 provides an increased amount of surface area contacting the subterranean formation 114. As a result, the subterranean cavern 150 provides increased inflow of formation fluids 114 into the cavern 150 as compared to the inflow into an equivalent depth of the wellbore 112. The formation fluids entering the subterranean cavern 150 from the surrounding subterranean formation 114 can include, for example, oil, water, and natural gas.

As formation fluids flow from the subterranean formation 114 into the subterranean cavern 150, the various types of fluids separate through gravity separation. For example, as depicted in FIG. 7, the formation fluid flowing into the subterranean cavern 150 from the subterranean formation 114 settles in the subterranean cavern 150 and separates into a water column 802, an oil column, 804, and a natural gas column 806. The residence time required for separation of the water 802 from the oil 804 in the formation fluid in the subterranean cavern 150 can be predetermined based on the dimensions of the subterranean cavern 150. For example, by increasing the target radius 204 of the subterranean cavern 150, the settling time for the formation fluids entering the subterranean cavern 150 can be increased, which results in improved separation of the water, oil, and natural gas in the subterranean cavern 150.

Once the oil and water in the subterranean cavern 150 have separated into an oil column 804 and a water column 802, the oil in the oil column 804 can be removed from the subterranean cavern 150 and pumped to the surface 102. Referring to FIGS. 7 and 8, a method of producing oil from the subterranean cavern 150 to the surface 102 will now be described.

As depicted in FIG. 7, once the formation fluid has filled the subterranean cavern 150 and separated under gravity to form an oil column 804, the control system 124 controls the submersible pump 704 to position the submersible pump 704 in the center of the oil column 804. By positioning the submersible pump 704 in the center of the oil column 804, the submersible pump 704 can efficiently pump the oil in the subterranean cavern 150 without lifting extraneous water. In some implementations, the submersible pump 704 is positioned in the center of the oil column 804 by the control system 124 based on signals received by the control system 124 from the liquid level sensor 706. For example, the control system 124 operates the downhole conveyance 710 to move the submersible pump 704 through the subterranean cavern 150. As the submersible pump 704 moves through the subterranean cavern 150, the liquid level sensor 706 sends signals to the control system 124 indicating the presence of a water-oil interface 810 (that is the bottom of the oil column 810) and an oil-gas interface 812 (that is the top of the oil column 810). For example, as previously discussed, the liquid level sensor 706 can be an ultrasonic sensor that emits pulse sound waves, and the sound waves emitted by the liquid level sensor 706 are reflected off the liquid interfaces back to the sensor 706. The reflected sound waves can be used to determine the presence of an water-oil interface 810 (that is the bottom of the oil column 810) and an oil-gas interface 812 (that is the top of the oil column 810) in the subterranean cavern 150.

Based on the position of the liquid level sensor 706 at the time that the liquid level sensor 706 detects each of the interfaces 810, 812, the control system 124 can determine the location of the bottom surface of the oil column 804 and the top surface of the oil column 804 within the subterranean cavern 150. Based on determining the location (for example, the depth) of the bottom and top surfaces of the oil column 804 within the subterranean cavern 150, the control system 124 can determine a position equidistant between the bottom and top surfaces of the oil column 804 in order to determine the location of the center of the oil column 804 within the subterranean cavern 150.

In response to determining the location of the center of the oil column 804 within the subterranean cavern 150, the control system 124 engages the downhole conveyance 710 to position the submersible pump 704 at the location identified as the center of the oil column 804. In some implementations, the depth of the submersible pump 704 within the subterranean cavern 150 is determined by the control system 124 based on signals received from one or more sensors (not shown) that indicate the number of turns that a reel coupled to the downhole conveyance 710 has completed. Based on the number of turns completed by the reel coupled to the downhole conveyance 710, the control system 124 can determine the length of the downhole conveyance 710 within the wellbore 112, which indicates the depth of the submersible pump 704 within the subterranean cavern 150. Once the submersible pump 704 is positioned in the center of the oil column 804, the control system 124 engages the submersible pump 704 to begin pumping oil out of the subterranean cavern 150 to the surface 102.

In some implementations, the control system 124 controls the submersible pump 704 to continue pumping until the control system 124 detects that a predetermined amount of oil has been pumped from the subterranean cavern 150 to the surface 102. In some implementations, the control system 124 controls the submersible pump 704 to continue pumping until the control system 124 receives a signal from the liquid level sensor 706 indicating detection of a water-gas interface 814, which indicates that the entire oil column 804 has been pumped from the subterranean cavern, as depicted in FIG. 8. Once the control system 124 receives a signal from the liquid level sensor 706 indicating detection of a water-gas interface 814, the control system 124 controls the submersible pump 704 to cease pumping to avoid pumping water from the water column 802. In some implementations, the control system 124 determines the volume of the oil column 804 based on the radius of the subterranean cavern 150 and the depth of the oil column 804 (as determined based on the liquid level sensor 706 measurements) and controls the submersible pump 704 to pump a volume of fluid equal to the determined volume of the oil column 804. In some implementations, the control system 124 implements a proportional integral derivative (PID) loop in conjunction with the liquid level sensor 706 to operate the submersible pump 704 based on the depth of the oil column 804. In some implementations, a set of tubing (not shown) is also provided to vent the natural gas column 806 from the subterranean cavern 150 to the surface 102. The natural gas can be vented with the oil at the surface. The motive force of the oil provided by the pump is sufficient to suck the gas at the exit of the well in the production line.

Figure 10:
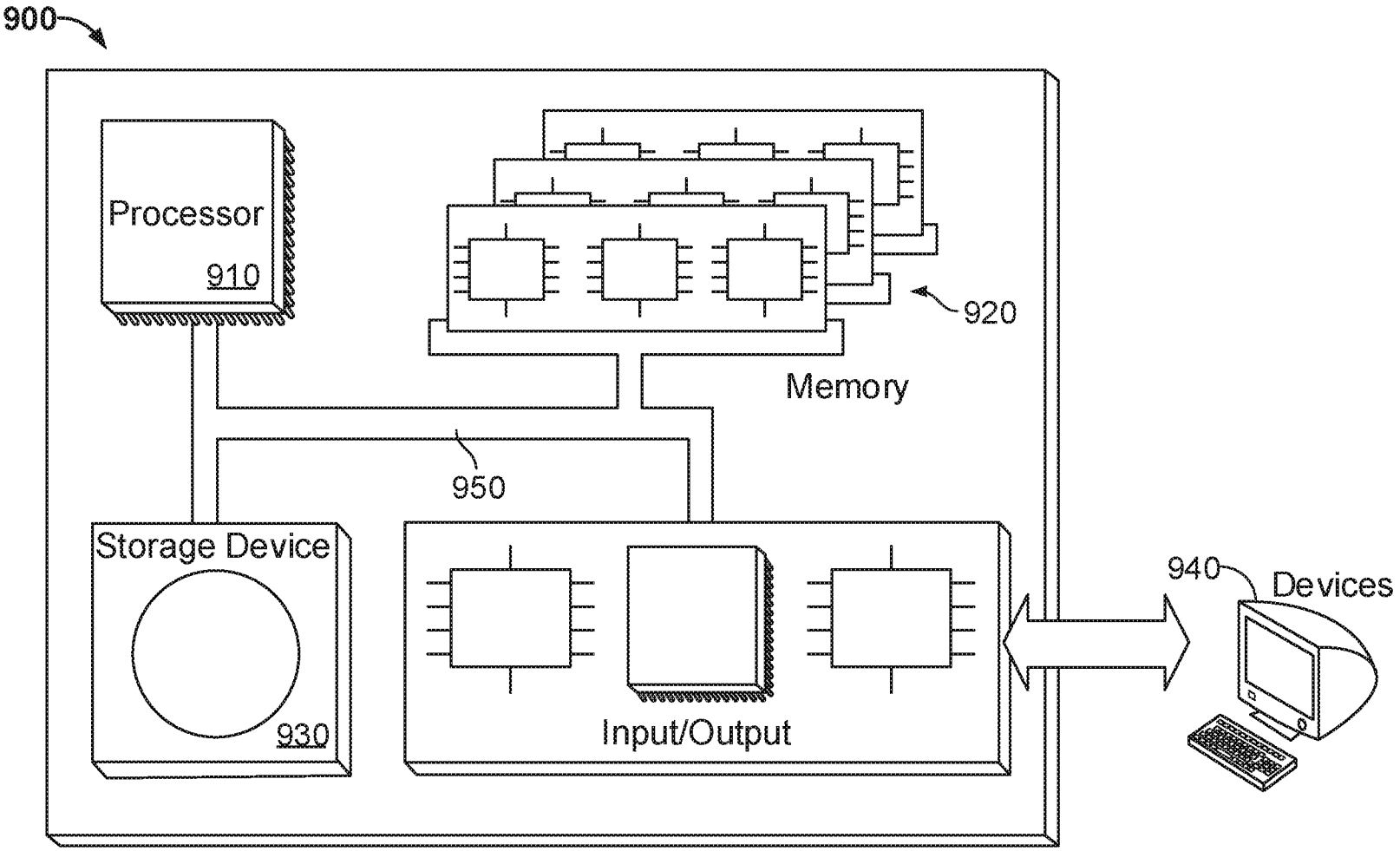
FIG. 10 is a schematic illustration of an example control system for a system for forming a subterranean cavern according to the present disclosure.

FIG. 10 is a schematic illustration of an example controller 900 (or control system 900) for a system for forming a subterranean cavern. For example, the controller 900 can be used for the operations described previously, for example as or as part of the control system 124, or other controllers described herein. For example, the controller 900 can be communicably coupled with, or as a part of, an acidizing tool (such as acidizing tool 116) and/or submersible pump (such as submersible pump 704) as described herein.

The controller 900 is intended to include various forms of digital computers, such as printed circuit boards (PCB), processors, digital circuitry, or other hardware. Additionally the system can include portable storage media, such as, Universal Serial Bus (USB) flash drives. For example, the USB flash drives can store operating systems and other applications. The USB flash drives can include input/output components, such as a wireless transmitter or USB connector that can be inserted into a USB port of another computing device.

The controller 900 includes a processor 910, a memory 920, a storage device 930, and an input/output device 940. Each of the components 910, 920, 930, and 940 are interconnected using a system bus 950. The processor 910 is capable of processing instructions for execution within the controller 900. The processor can be designed using any of a number of architectures. For example, the processor 910 can be a CISC (Complex Instruction Set Computers) processor, a RISC (Reduced Instruction Set Computer) processor, or a MISC (Minimal Instruction Set Computer) processor.

In one implementation, the processor 910 is a single-threaded processor. In another implementation, the processor 910 is a multi-threaded processor. The processor 910 is capable of processing instructions stored in the memory 920 or on the storage device 930 to display graphical information for a user interface on the input/output device 940.

The memory 920 stores information within the controller 900. In one implementation, the memory 920 is a computer-readable medium. In one implementation, the memory 920 is a volatile memory unit. In another implementation, the memory 920 is a non-volatile memory unit.

The storage device 930 is capable of providing mass storage for the controller 900. In one implementation, the storage device 930 is a computer-readable medium. In various different implementations, the storage device 930 can be a floppy disk device, a hard disk device, an optical disk device, or a tape device.

The input/output device 940 provides input/output operations for the controller 900. In one implementation, the input/output device 940 includes a keyboard, a pointing device, or both. In another implementation, the input/output device 940 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer. Additionally, such activities can be implemented via touch-screen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While certain implementations have been described above, other implementations are possible.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method comprising:

spraying acid onto an inner wall of a wellbore, the wellbore formed in a subterranean zone with entrapped hydrocarbons that flow into the subterranean zone, wherein spraying the acid forms a subterranean cavern within a portion of the wellbore, the subterranean cavern being wider than the wellbore, the entrapped hydrocarbons flow into the subterranean cavern, the entrapped hydrocarbons comprising liquid hydrocarbons and water, the liquid hydrocarbons and the water separate under gravity within the subterranean cavern; and drawing the liquid hydrocarbons from the subterranean cavern to a surface of the wellbore, wherein drawing the liquid hydrocarbons from the subterranean cavern to a surface of the wellbore comprises positioning a pump in an oil column formed in the subterranean cavern, wherein positioning the pump in the oil column formed in the subterranean cavern comprises:

positioning a liquid level sensor in the subterranean cavern, wherein the liquid level sensor is configured to detect oil-water interfaces and oil-gas interfaces;

based on detecting at least one of an oil-water interface and an oil-gas interface, determining a center of the oil column; and positioning the pump at the center of the oil column.

2. The method of claim 1, wherein spraying acid onto an inner wall of a wellbore further comprises:

positioning an acidizing tool within the wellbore supplying acid to the acidizing tool;

rotating the acidizing tool about 360 degrees; and in response to determining that a radius of a portion of the wellbore proximate the acidizing tool is about 300 percent to about 400 percent an initial radius of the wellbore, raising the acidizing tool within the wellbore towards the surface.

3. The method of claim 2, wherein determining that the radius of the portion of the wellbore proximate the acidizing tool is about 300 percent to about 400 percent an initial radius of the wellbore comprises measuring the radius of the portion of the wellbore proximate the acidizing tool using one or more ultrasonic sensors coupled to the acidizing tool.

4. The method of claim 2, wherein an upper portion of the subterranean cavern is dome-shaped.

5. The method of claim 4, further comprising rotating the acidizing tool between a first position and a second position to form the upper portion of the subterranean cavern.

6. The method of claim 5, wherein:

the acidizing tool comprises:

a center hub coupled to an end of a downhole conveyance;

one or more projections extending radially from the center hub; and an opening through each of the one or more projections, wherein the one or more projections are positioned substantially perpendicular to a longitudinal axis of the downhole conveyance in the first position and are positioned substantially parallel to the longitudinal axis of the downhole conveyance in the second position.

7. The method of claim 1, wherein determining the center of the oil column comprises:

receiving a signal from the liquid level sensor indicating a depth corresponding to an oil-gas interface in the subterranean cavern;

receiving a signal from the liquid level sensor indicating a depth corresponding to an oil-water interface in the subterranean cavern; and calculating an average of the depth of the oil-gas interface and the depth of the oil-water interface.

8. The method of claim 1, wherein:

the liquid level sensor is coupled to the pump; and positioning the liquid level sensor in the subterranean cavern comprises lowering the pump into the subterranean cavern.

9. A system for producing liquid hydrocarbons from a formation, the system comprising:

an acidizing tool configured to rotate and spray acid onto an inner wall of a wellbore to form a subterranean cavern; and a controller communicably coupled to the acidizing tool, the controller configured to perform operations comprising:

controlling the acidizing tool to rotate about a downhole conveyance coupled to the acidizing tool and spray acid onto an inner wall of a wellbore;

in response to receiving a signal indicating that a radius of the wellbore is at least a threshold radius, causing the acidizing tool to be raised uphole within the wellbore; and in response to determining that a depth of the subterranean cavern is at least a threshold depth, rotating the acidizing tool to form a dome-shaped upper portion of the subterranean cavern, wherein the acidizing tool comprises:

one or more projections extending radially from a hub coupled to an end of a downhole conveyance; and an opening through each of the one or more projections, wherein the operations further comprise controlling the acidizing tool to rotate between a first position and a second position to form the upper portion of the subterranean cavern, wherein the one or more projections are positioned substantially perpendicular to a longitudinal axis of the downhole conveyance in the first position and the one or more projections are positioned substantially parallel to the longitudinal axis of the downhole conveyance in the second position.

10. The system of claim 9, wherein the depth of the subterranean cavern is about 30 percent to about 50 percent a total depth of the wellbore.

11. The system of claim 9, wherein the depth of the subterranean cavern is equal to a depth of an oil-bearing subterranean formation.

12. The system of claim 9, wherein:

the system further comprises:

a submersible pump configured to draw liquid hydrocarbons from the subterranean cavern; and a liquid level sensor;

the controller is communicably coupled to the submersible pump and the liquid level sensor; and the operations further comprise:

in response to receiving a first signal from the liquid level sensor indicating an oil-water interface and a second signal from the liquid level sensor indicating an oil-gas interface, determining a center of an oil column formed by gravity separation in the subterranean cavern; and in response to determining the center of the oil column, positioning the submersible pump in the center of the oil column.

13. The system of claim 12, wherein:

the liquid level sensor is coupled to the submersible pump; and the operations further comprise lowering the submersible pump through the subterranean cavern.

14. The system of claim 9, wherein:

the system further comprises one or more ultrasonic sensors coupled to the acidizing tool; and the signal indicating that the radius of the wellbore is at least a threshold radius is received by the controller from the one or more ultrasonic sensors.

15. The system of claim 9 wherein:

the system further comprises an acid source fluidly coupled to the acidizing tool; and controlling the acidizing tool to spray acid onto an inner wall of a wellbore comprises pumping acid from the acid source to the acidizing tool.

* * * * *